US008566082B2

(12) United States Patent
Barriac et al.

(10) Patent No.: US 8,566,082 B2
(45) Date of Patent: Oct. 22, 2013

(54) METHOD AND SYSTEM FOR THE INTEGRAL AND DIAGNOSTIC ASSESSMENT OF LISTENING SPEECH QUALITY

(75) Inventors: Vincent Barriac, Trelevern (FR); Nicolas Cote, Brest (FR); Valerie Gautier-Turbin, Louannec (FR); Sebastian Moeller, Berlin (DE); Alexander Raake, Berlin (DE); Marcel Waeltermann, Berlin (DE); Ulrich Heute, Heikendorf (DE); Kirstin Scholz, Kiel (DE)

(73) Assignees: Deutsche Telekom AG, Bonn (DE); France Telecom, Paris (FR)

( * ) Notice: Subject to any disclaimer, the term of this patent is extended or adjusted under 35 U.S.C. 154(b) by 1334 days.

(21) Appl. No.: 12/208,508

(22) Filed: Sep. 11, 2008

(65) Prior Publication Data

US 2009/0099843 A1 Apr. 16, 2009

(30) Foreign Application Priority Data

Sep. 11, 2007 (EP) ..... 07017773

(51) Int. Cl.
*G10L 11/00* (2006.01)
*G10L 19/14* (2006.01)

(52) U.S. Cl.
USPC ..... 704/200.1; 704/205

(58) Field of Classification Search
USPC ..... 704/200.1, 200, 201, 205, 207, 704/226–228
See application file for complete search history.

(56) References Cited

U.S. PATENT DOCUMENTS

| | | | | |
|---|---|---|---|---|
| 7,512,534 | B2 * | 3/2009 | Chu | 704/211 |
| 8,014,999 | B2 * | 9/2011 | Beerends | 704/207 |
| 2005/0159944 | A1 * | 7/2005 | Beerends | 704/225 |
| 2009/0018825 | A1 * | 1/2009 | Bruhn et al. | 704/222 |

FOREIGN PATENT DOCUMENTS

| | | |
|---|---|---|
| EP | 1206104 | 5/2002 |
| EP | 1465156 | 10/2004 |

OTHER PUBLICATIONS

Kirstin Scholz Al: "Estimation of the quality dimension directness/frequency content, for the instrumental assessment of speech quality" InterSpeech 2006 and 9th International Conference on Spoken Language Processing, InterSpeech 2006—ICSLP, vol. 3, 2006, pp. 1523-1526.*

Tom Goldstein et al. "Perceptual speech quality assessment in acoustic and binaural applications" Acoustics, Speech, and Signal Processing, 2004. Proceedings (ICASSP '04). IEEE International Conference on Montreal, Quebec, Canada May 17-21, 2004, Piscafaway, N J, USA, IEEE, vol. 3, 17, (May 17, 2004), pp. 1064.1067.*

(Continued)

*Primary Examiner* — Angela A Armstrong
(74) *Attorney, Agent, or Firm* — Leydig, Voit & Mayer, Ltd.

(57) ABSTRACT

A method for determining a speech quality measure of an output speech signal with respect to an input speech signal, wherein the input signal passes through a signal path of a data transmission system resulting in the output signal, includes the steps of pre-processing the output signal; determining at least one of an interruption rate of the pre-processed output signal and a measure for an intensity of musical tones present in the pre-processed output signal; and determining the speech quality measure from at least one of the interruption rate and the measure for the intensity of the musical tones.

37 Claims, 2 Drawing Sheets

(56) References Cited

OTHER PUBLICATIONS

Antony W. Rix et al. "Perceptual evaluation speech quality (PESQ)—a new method for speech quality assessment of telephone networks and codecs", 200t IEEE International Conference on Acoustics, Speech, and Signal Processing, Proceedings, (ICASSP), Salt Lake City, UT, May 7 2001, New York, NY, US, vol. 2, May 7, 2001, pp. 749-752.*
Lijing Ding et al. "Assessment of Effects of Packet Loss on Speech Quality in VoIP", Haptic, Audio and Visual Enviroments and their Applications, 2003, HA VE 2003, Proceedings, The 2nd IEEE International Workshop on Sep. 20-21, 2003, Piscataway, NJ, USA, IEEE, Sep. 20, 2003, pp. 49-54, XP010668258.
Antony W. Rix et al. "Perceptual evaluation speech quality (PESQ)—a new method for speech quality assessment of telephone networks and codecs", 2001 IEEE International Conference on Acoustics, Speech, and Signal Processing, Proceedings, (ICASSP), Salt Lake City, UT, May 7 2001, [IEEE International Conference on Acoustics. Speech, and Signal Processing (ICASSP)], New York, NY, US, vol. 2, May 7, 2001, pp. 749-752, XP010803764.
Antony Rix et al. "Robust perceptual assessment of end-to-end audio quality", Applications of Signal Processing to Audio and Acoustics, 1999 IEEE Workshop on New Paltz, NY, USA Oct. 17-20, 1999, Piscataway, NJ, USA, IEEE, US, Oct. 17, 1999, pp. 39-42, XP010365062.
Dr. John G, Beerends, KPN Reasearch: "Proposal for the use of draft recommondation P.862, The perceptual evaluation of speech quality (PESQ), For Measurements in the Acoustic Domain with Background Masking Moise, D.6", ITU-T Draft Study Period 2001-2004, International Telecommunication Union, Geneva, CH, vol. Study Group 12, Feb. 19, 2001, pp. 1-5, XP017415961.
Tosqa model described in ITU-T Contribution Com 12-19, 2001, "Results of objective speech quality assessment including receiving terminals using the advanced TOSQA2001", pp. 1-5.
"The Perceptual Analysis Measurement System for Robust End-to-end Speech Quality Assessment" by A.W. Rix and M.P. Hollier, Proc. IEEE ICASSP, 2000, vol. 3, pp. 1-4.
"Objective Modelling of Speech Quality with a Psychoacoustically Validated Auditory Model" by M. Hansen and B. Kollmeier, 2000, J. Audio Eng. Soc., vol. 48, pp. 395-409.
"Objective Estimation of Perceived Speech Quality—Part I: Development of the Measuring Normalizing Block Technique" by S. Voran, IEEE Trans. Speech Audio Process., 1999, vol. 7, No. 4, pp. 371-382.
"Instrumentelle Verfahren zur Sprachqualitatsschatzung—Modelle auditiver Tests" by J. Berger, 1998, PhD thesis, University of Kiel, Shaker Verlag, Aachen, Germany, 4 pages (concise statement of relevance in Specification on p. 3).
"Psychoakustisch motivierte Masse zur instrumentellen Sprachguetebeurteilung" by M. Hauenstein, 1997, PhD thesis, University of Kiel, Shaker Verlag, Aachen, Germany (concise statement of relevance in Specification on p. 3).
"An objective Measure for Predicting Subjective Quality of Speech Coders" by S. Wang, A. Sekey and A. Gersho, 1992, IEEE J. Sel. Areas Commun., vol. 10, No. 5, pp. 819-829.
2001 Version of TOSQA "Results of objective speech quality assessment including receiving terminals using the advanced TOSQA2001", ITU-T Contr. COM 12-19, 2001, pp. 1-7.
B-PAMS, "Results of Quality Assessment of Wideband Speech Using PAMS", ITU-T Del. Contr. D.001, 2001, pp. 1-5.
Tu-T Del. Contr. D.070 (2005), "Objective Quality Assessment of Wideband Speech by an Extension of the ITU-T Recommendation P.862" by A. Takahashi et al., 2005, in Proc. 9th Int. Conf. on Speech Communication and Technology (Interspeech Lisboa 2005), Lisbon, pp. 3153-3156.
"Objective Quality Assessment of Wideband Speech Coding" by N. Kitawaki et al., 2005, In IEICE Trans. on Commun., vol. E88-B(3), pp, 1111-1118.
Aquavit—Assessment of Quality for Audio-Visual Signals over Internet and UMTS, Eurescom Project P.905, Mar. 2001, pp. 1-108.
ITU-T Contr. COM 12-26, 2006, pp. 1-13.
"Underlying Quality Dimensions of Modern Telephone Connections" by M. Waltermann et al., 2006, in: Proc. 9th Int. Conf. on Spoken Language Processing (Interspeech 2006—ICSLP), Pittsburgh PA, pp. 2170-2173.
"Relative Approach" described in "Objective Evaluation of Acoustic Quality Based on a Relative Approach" by K. Genuit, 1996, in: Proc. Internoise'96, Liverpool, UKGenuit (1996) and Kettler (2003) the "Relative Approach".
"Application of the Relative Approach to Optimize Packet Loss Concealment Implementations" by F. Kettler et al., 2003, in: Fortschritte der Akustik—DAGA 2003, Aachen, Mar. 18-20, 2003, Deutsche Gesellschaft fuer Akustik, DEGA e.V., Germany, pp. 662-663.
"Untersuchungen zur messtechnischen Erfassung und systematischen Beeinflussung der Sprachqualitats-dimension 'Rauschhaftigkeit'" by Ch. Kuehnel, 2007, Diploma Thesis, Institute for Circuit and System Theory, Christian-Albrechts-University, Kiel, Germany, p. 1-105 (concise statement of relevance in Specification on p. 29).
"Procedure for Calculating the Loudness of Temporally Variable Sounds" by E. Zwicker, 1977, J. Acoust. Soc. Ame., vol. 62, No. 3, pp. 675-682.
"A Model of Loudness Applicable to Time-Varying Sounds" by B.R. Glasberg and B.C.J. Moore, 2002, J. Audio Eng. Soc., vol. 50, pp. 331-341.
ITU-T recommendation G.107 (2005). The extended R scale is for instance described in "Impairment Factor Framework for Wide-Band Speech Codecs" by S. Moeller et al., 2006, IEEE Trans. on Audio, Speech and Language Processing, vol. 14, No. 6, pp. 1969-1976.
ITU-T Rec. P.800, and P.800.1, 1996, pp. 1-4, ITU-T Rec. P.830, or in the ITU-T Handbook on Telephonometry, 1992, pp. 1-37.
Marcel Waeltermann et al. "Perceptual Dimensions of Wideband-transmitted Speech" Second ISCA/DEGA Tutorial and Research Workshop on Perceptual Quality of Systems, Berlin, [Online] Sep. 4, 2006, pp. 103-108, XP002500838, Berlin, Germany, Retrieved from the Internet: URL:http://www.isca-speech.org/archive/pqs2006/pqs6 103.html>.
ITU-T Contr. COM 12-4, 2004, pp. 1-12.
TOSQA model, "Telecommunication Objective Speech Quality Assessment", Berger, 1998, pp. 1-12.
Kirstin Scholz Al: "Estimation of the quality dimension "directness/frequency content" for the instrumental assessment of speech quality" InterSpeech 2006 and 9th International Conference on Spoken Language Processing, InterSpeech 2006—ICSLP—InterSpeech 2006 and 9th International Conference on Spoken Language Processing, InterSpeech 2006—ICSLP 2006 Dummy PUBID US, vol. 3, 2006, pp. 1523-1526, XP002500837.
Tom Goldstein et al. "Perceptual speech quality assessment in acoustic and binaural applications" Acoustics, Speech, and Signal Processing, 2004. Proceedings. (ICASSP '04). IEEE International Conference on Montreal, Quebec, Canada May 17-21, 2004, Piscataway, NJ, USA, IEEE, vol. 3, May 17, 2004, pp. 1064-1067, XP010718377.
European Search Report for European Patent Application No. 07 01 7773, dated Oct. 23, 2008.
Moeller et al., Describing Telephone Speech Codec Quality Degradations by Means of Impairment Factors, J. Audio Eng. Soc., vol. 50, No. 9, Sep. 2002, p. 667-680.
Côte et al., Analysis of a Quality Prediction Model for Wideband Speech Quality, the WB-PESQ, in: Proc. 2nd ISCA Tutorial and Research Workshop on Perceptual Quality of Systems, Berlin 2006, p. 115-122.

* cited by examiner

METHOD AND SYSTEM FOR THE INTEGRAL AND DIAGNOSTIC ASSESSMENT OF LISTENING SPEECH QUALITY

CLAIM OF PRIORITY

This application claims the benefit of priority of European Patent Application No. EP 07 017 773.8-2225, filed Sep. 11, 2007, which is hereby incorporated by reference in its entirety herein.

FIELD

The invention relates to communication systems in general, and in particular to a method and a system for determining the transmission quality of a communication system, in particular of a communication system adapted for speech transmission.

BACKGROUND

For the planning, design, installation, optimization, and monitoring of telecommunication networks providing speech transmission capabilities, the quality experienced by the user of the related service is taken into account. Quality is usually quantified by carrying out perceptual experiments with human subjects in a laboratory environment. For assessing the quality of transmitted speech, test subjects are either put into a listening-only or a conversational situation, experience speech samples under these conditions, and rate the quality of what they have heard on a number of rating scales. The Telecommunication Standardization Sector of the International Telecommunication Union provides guidelines for such experiments, and proposes a number of rating scales to be used, as for instance described in ITU-T Rec. P.800, 1996, ITU-T Rec. P.830, 1996, or in the ITU-T Handbook on Telephonometry, 1992. The most frequently used scale is a 5-point absolute category rating scale on "overall quality". The averaged score of the subjective judgments obtained on this scale is called a Mean Opinion Score, MOS. MOS scores can be qualified as to whether they have been obtained in a listing-only or conversational situation, and in the context of narrow-band (300-3400 Hz audio bandwidth), wideband (50-7000 Hz) or mixed (narrow-band and wideband) transmission channels, as is described for instance in ITU-T Rec. P.800.1 (2006).

Because of the efforts and costs required to run subjective tests, algorithms have been developed which estimate the subjective rating to be expected in a perceptual experiment on the basis of speech signals, or of parameters characterizing the telecommunication network. Speech signals can be generated artificially, for instance by using simulations, or they can be recorded in operating networks. Depending on whether speech signals at the input of the transmission channel under consideration are available or not, different types of signal-based models can be distinguished:

- a full-reference model, which estimates subjective listening-quality scores by calculating a distance or similarity between adequate representations of the input and the output signal, or by deriving a distortion measure from the comparison of input and output signals, and transforming the result on a scale related to subjective quality,
- a no-reference model, which estimates subjective listening-quality scores on the basis of the output signal alone; this can be done e.g. by generating an artificial reference within the algorithm, and performing a subsequent signal-comparison analysis, as stated above, and

- a conversational quality model, which estimates quality scores for a listening-only, a talking-only, and/or a conversational situation.

Several forms of full-reference models exist for speech and audio transmission channels. They usually consist of a preprocessing step for the input and the output signals, a transformation into an internal representation, a comparison step resulting in an index, followed by integration and transformation steps resulting in an estimated quality score.

For narrow-band speech transmission, full-reference models include the PESQ model described in ITU-T Recommendation P.862 (2001), its precursor PSQM described in ITU-T Recommendation P.861 (1998), the TOSQA model described in ITU-T Contribution Com 12-19 (2001), as well as PAMS described in "The Perceptual Analysis Measurement System for Robust End-to-end Speech Quality Assessment" by A. W. Rix and M. P. Hollier, Proc. IEEE ICASSP, 2000, vol. 3, pp. 1515-1518. Further models are described in "Objective Modelling of Speech Quality with a Psychoacoustically Validated Auditory Model" by M. Hansen and B. Kollmeier, 2000, J. Audio Eng. Soc., vol. 48, pp. 395-409, "Objective Estimation of Perceived Speech Quality—Part I: Development of the Measuring Normalizing Block Technique" by S. Voran, IEEE Trans. Speech Audio Process., 1999, vol. 7, no. 4, pp. 371-382, "Instrumentelle Verfahren zur Sprachqualitätsschätzung—Modelle auditiver Tests" by J. Berger, 1998, PhD thesis, University of Kiel, Shaker Verlag, Aachen, "Psychoakustisch motivierte Maβe zur instrumentellen Sprachgütebeurteilung" by M. Hauenstein, 1997, PhD thesis, University of Kiel, Shaker Verlag, Aachen, and "An objective Measure for Predicting Subjective Quality of Speech Coders" by S. Wang, A. Sekeyand A. Gersho, 1992, IEEE J. Sel. Areas Commun., vol. 10, no. 5, pp. 819-829.

The model by Wang, Sekey and Gersho uses a Bark Spectral Distortion (BSD) which does not include a masking effect.

The PSQM model (Perceptual Speech Quality Measure) comes from the PAQM model (Perceptual Audio Quality Measure) and was specialized only for the evaluation of speech quality. The PSQM includes as new cognitive effects the measure of noise disturbance in silent interval and an asymmetry of perceptual distortion between components left or introduced by the transmission channel. The model by Voran, called Measuring Normalizing Block, used an auditory distance between the two perceptually transformed signals. The model by Hansen and Kollmeier uses a correlation coefficient between the two transformed speech signals to a higher neural stage of perception. The PAMS (Perceptual Analysis Measurement System) model is an extension of the BSD measure including new elements to rule out effects due to variable delay in Voice-over-IP systems and linear filtering in analogue interfaces. The TOSQA model (Telecommunication Objective Speech Quality Assessment; Berger, 1998) assesses an end-to-end transmission channel including terminals using a measure of similarity between both perceptually transformed signals. The PESQ (Perceptual Evaluation of Speech Quality) model is a combination of two precursor models, PSQM and PAMS including partial frequency response equalization.

For wideband (50-7000 Hz) or mixed narrow-band and wideband speech transmission channels, only few proposals have been made. The ITU-T currently recommends an extension of its PESQ model in Rec. P.862.2 (2005), called wideband PESQ, WB-PESQ, which mainly consists in replacing the input filter characteristics of PESQ by a high-pass filter, and applying it to both narrow-band and wideband speech signals. In addition, the 2001 version of TOSQA (ITU-T Contr. COM 12-19, 2001) has shown to be able to estimate MOS also in a wideband context, as the WB-PAMS (ITU-T Del. Contr. D.001, 2001).

Several studies are described in the literature to evaluate the consistency of WB-PESQ estimations with subjective judgments, as for instance ITU-T Del. Contr. D.070 (2005), "Objective Quality Assessment of Wideband Speech by an Extension of the ITU-T Recommendation P.862" by A. Takahashi et al., 2005, in Proc. 9th Int. Conf. on Speech Communication and Technology (Interspeech Lisboa 2005), Lisbon, pp. 3153-3156, "Objective Quality Assessment of Wideband Speech Coding" by N. Kitawaki et al., 2005, in IEICE Trans. on Commun., vol. E88-B(3), pp. 1111-1118, or "Analysis of a Quality Prediction Model for Wideband Speech Quality, the WB-PESQ" by N. Côté et al., 2006, in: Proc. 2nd ISCA Tutorial and Research Workshop on Perceptual Quality of Systems, Berlin, pp. 115-122.

The evaluation procedure usually consists in analyzing the relationship between auditory judgments obtained in a listening-only test, MOS_LQS (MOS Listening Quality Subjective), and their corresponding instrumentally-estimated MOS_LQO (MOS Listening Quality Objective) scores. For example, in Takahashi et al. (2005), three wideband speech codecs were evaluated with WB-PESQ, and a bias was found for the G.722.1 codec, in that MOS_LQO is significantly lower than MOS_LQS. The same effect was observed in Kitawaki et al. (2005) for the G.722.2 codec, although the average correlation coefficient is about 0.90. WB-PESQ was shown to be able to predict the codec ranking in the listeners' judgments, but was not able to quantify the perceptual difference between the codecs.

The following table shows Pearson correlation coefficients of the database AQUAVIT (AQUAVIT—Assessment of Quality for Audio-Visual Signals over Internet and UMTS, Eurescom Project P.905, March 2001) for three wideband models:

| Test: | Bandwidth: | WB-PESQ | TOSQA-2001 | WB-PAMS |
|---|---|---|---|---|
| 1 | Mixed Band | 0.952 | 0.966 | 0.946 |
| 2a | Narrow Band | 0.981 | 0.954 | 0.981 |
| 2b | Wide Band | 0.977 | 0.982 | 0.992 |

As can be seen from this data the known models already provide estimated quality scores with significant correlation. However, the models typically do not have the same accuracy for narrowband- and wideband-transmitted speech. Furthermore, if a poor quality of a transmission path is detected no information on the source of the quality loss can be derived from the estimated quality score.

SUMMARY

In one aspect, the present invention provides a method for determining a speech quality measure of an output speech signal with respect to an input speech signal, wherein the input signal passes through a signal path of a data transmission system resulting in the output signal. The method includes the steps of: pre-processing the output signal; determining at least one of an interruption rate of the pre-processed output signal and a measure for an intensity of musical tones present in the pre-processed output signal; and determining the speech quality measure from at least one of the interruption rate and the measure for the intensity of the musical tones.

In another aspect, the present invention provides a system for determining a speech quality measure of an output speech signal with respect to an input speech signal, wherein the input speech signal passes through a signal path of a data transmission system resulting in the output speech signal. The system includes: a first processing unit for determining a first speech quality measure from the input speech signal and the output speech signal, the first processing unit having outputs; at least one device configured to determine a second speech quality measure from the input speech signal and the output speech signal; and an aggregation unit connected to the outputs of the first processing unit and to the at least one device. The aggregation unit has an output configured to provide the speech quality measure. The aggregation unit is configured to calculate an output value from the first processing unit outputs and each of the at least one device depending on a pre-defined algorithm.

DETAILED DESCRIPTION

Figure 1:
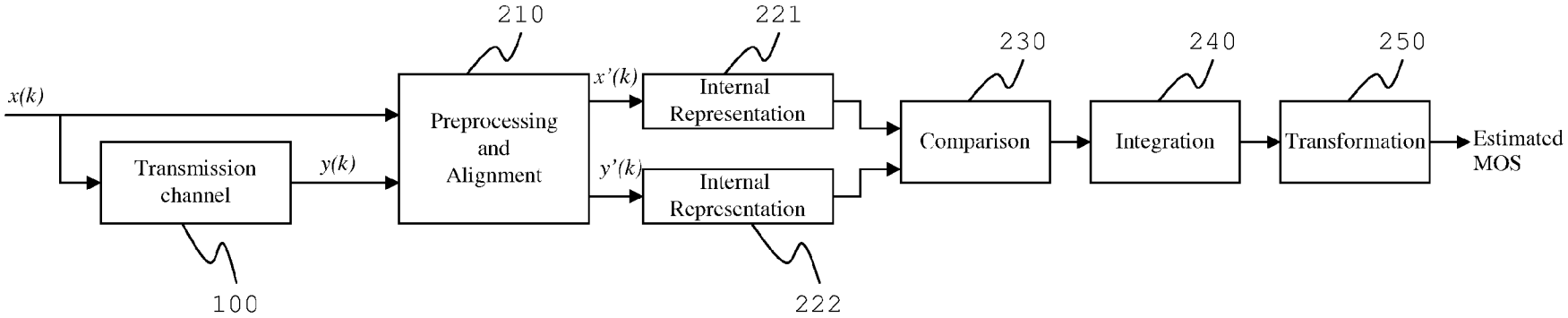
Fig. 1 Prior Art
FIG. 1 a schematic view of a prior art full-reference model.

It is an aspect of the present invention to provide a new and improved approach to determine a speech quality measure related to a signal path of a data transmission system utilized for speech transmission. Another, alternative, aspect of the invention is to provide a speech quality measure with a high accuracy for narrowband- and wideband-transmitted speech. Still another, alternative, aspect of the invention is to provide a speech quality measure from which a source of quality loss in the signal path can be derived.

The inventors found that apart from an estimation of overall speech quality, as it is expressed for instance on an overall quality scale according to ITU-T Rec. P.800 (1996), perceptual dimensions are important for the formation of quality. Furthermore, perceptual dimensions provide a more detailed and analytic picture of the quality of transmitted speech, e.g. for comparison amongst transmission channels, or for analyzing the sources of particular components of the transmission channel on perceived quality. Dimensions can be defined on the basis of signal characteristics, as it is proposed for instance in ITU-T Contr. COM 12-4 (2004) or ITU-T Contr. COM 12-26 (2006), or on the basis of a perceptual decomposition of the sound events, as described in "Underlying Quality Dimensions of Modern Telephone Connections" by M. Wältermann et al., 2006, in: Proc. 9th Int. Conf. on Spoken Language Processing (Interspeech 2006—ICSLP), Pittsburgh Pa., pp. 2170-2173. The invention with great advantage proposes methods to determine such individual dimensions and to integrate them into a full-reference signal-based model for speech quality estimation. The term "perceptual dimension" of a speech signal is used herein to describe a characteristic feature of a speech signal which is individually perceivable by a listener of the speech signal.

Thus, one embodiment of the invention takes the form of a full-reference model, which estimates different speech-quality-related scores, in particular for a listening-only situation.

Accordingly, in a first embodiment an inventive method for determining a speech quality measure of an output speech signal with respect to an input speech signal, wherein said input signal passes through a signal path of a data transmission system resulting in said output signal, comprises the steps of pre-processing said input and/or output signals, determining an interruption rate of the pre-processed output signal and/or determining a measure for the intensity of musical tones present in the pre-processed output signal, and determining said speech quality measure from said interruption rate and/or said measure for the intensity of musical tones. This method is adapted to determine the perceptual dimension related to the continuity of the output signal.

Typically both the input and output signals are pre-processed, for instance for the purpose of level-alignment. Since in this first embodiment, however, typically only the pre-processed output signal is further processed, it can also be of advantage to only pre-process the output signal.

In order to detect interruptions and/or musical tones in the signal, most preferably a discrete frequency spectrum of the pre-processed output signal is determined within at least one pre-defined time interval, wherein the discrete frequency spectrum preferably is a short-time spectrum generated by means of a discrete Fourier transformation (DFT). The resulting discrete frequency spectrum accordingly with advantage comprises spectral amplitude values for frequency/time pairs based on a pre-defined sampling rate and a number of pre-defined frequency bands.

The pre-defined frequency bands preferably lie within a pre-defined frequency range with a lower boundary between 0 Hz and 500 Hz and an upper boundary between 3 kHz and 20 kHz. The pre-defined frequency range is chosen depending on the application, in particular depending on whether the speech signals are narrowband, wideband or full-band signals. Typically, narrowband speech transmission channels are associated with a frequency range between 300 Hz and 3.4 kHz, while wideband speech transmission channels are associated with a frequency range between 50 Hz and 7 kHz. Full-band typically is associated with having an upper cut-off frequency above 7 kHz, which, depending on the purpose, can be for instance 10 kHz, 15 kHz, 20 kHz, or even higher. So, depending on the purpose, the pre-defined frequency bands preferably lie within one of the above frequency ranges. Although the invention is not so limited, and other frequency ranges are also within its contemplation.

Accordingly, for applications in which the speech signals are narrowband signals the pre-defined frequency bands can be within the typical frequency range of the telephone-band, i.e. in a range essentially between 300 Hz and 3.4 kHz. For wideband or for mixed narrowband and wideband speech applications the lower boundary is 50 Hz and the upper boundary lies between 7 kHz and 8 kHz. Further, for full-band applications the upper boundary can be above 7 kHz, in particular above 10 kHz, in particular above 15 kHz, in particular above 20 kHz.

Further, the pre-defined frequency bands can be essentially equidistant, in particular for the detection of musical tones.

The term short-time frequency spectrum refers to an amplitude density spectrum, which is typically generated by means of FFT (Fast Fourier transform) for a pre-defined interval. In a short-time frequency spectrum the analyzing interval is only of short duration which provides a good snap-shot of the frequency composition, however at the expense of frequency resolution. The sampling rate utilized for generating the discrete frequency spectrum of the pre-processed output signal therefore preferably lies between 0.1 ms and 200 ms, in particular between 1 ms and 20 ms, in particular between 2 ms and 10 ms.

Interruptions in the pre-processed output signal with advantage are detected by determining a gradient of the discrete frequency spectrum, wherein the start of an interruption is identified by a gradient which lies below a first threshold and the end of an interruption is identified by a gradient which lies above a second threshold.

For the detection of musical tones preferably for each frequency/time pair of the discrete frequency spectrum an expected amplitude value is determined, wherein said musical tones are detected by determining frequency/time pairs for which the spectral amplitude value is higher than the expected amplitude value and the difference between the spectral amplitude value and the expected amplitude value exceeds a pre-defined threshold.

In this first embodiment, the speech quality measure preferably is determined by calculating a linear combination of the interruption rate and the measure for the intensity of detected musical tones. However, also a non-linear combination lies within the scope of the invention.

In a second embodiment in accordance with the invention, a method for determining a speech quality measure of an output speech signal with respect to an input speech signal, wherein said input signal passes through a signal path of a data transmission system resulting in said output signal, comprises the steps of pre-processing said input and/or output signals, determining from the pre-processed input and output signals at least one quality parameter which is a measure for background noise introduced into the output signal relative to the input signal, and/or the center of gravity of the spectrum of said background noise, and/or the amplitude of said background noise, and/or high-frequency noise introduced into the output signal relative to the input signal, and/or signal-correlated noise introduced into the output signal relative to the input signal, wherein said speech quality measure is determined from said at least one quality parameter. This method is adapted to determine the perceptual dimension related to the noisiness of the output signal relative to the input signal.

In the pre-processed input and output signals intervals of speech activity and intervals of speech pauses are detected. The quality parameter which is a measure for the background noise most advantageously is determined by comparing discrete frequency spectra of the pre-processed input and output signals within said speech pauses. These discrete frequency spectra are determined as short-time frequency spectra as described above. The discrete frequency spectra are compared by calculating a psophometrically weighted difference between the spectra in a pre-defined frequency range with a lower boundary between 0 Hz and 0.5 Hz and an upper boundary between 3.5 kHz and 8.0 kHz.

Suitable boundary values with respect to background noise for narrowband applications have been found by the inventors to be 0 Hz for the lower boundary and 4 kHz for the upper boundary. For wideband applications the lower boundary is 0 Hz and the upper boundary lies between 7 kHz and 8 kHz. Depending on the application or purpose, of course, also other frequency ranges can be chosen and are within the scope of the invention.

Further, the method embodying the invention comprises the step of calculating the difference between the center of gravity of the spectrum of said background noise and a pre-defined value representing an ideal center of gravity, wherein said pre-defined value in particular equals 2 kHz, since the center of gravity in a frequency range between 0 and 4 kHz for "white noise" would have this value.

The quality parameter which is a measure for the high-frequency noise is determined as a noise-to-signal ratio in a pre-defined frequency range with a lower boundary between 3.5 kHz and 8.0 kHz and an upper boundary between 5 kHz and 30 kHz.

For narrowband applications a lower boundary of 4 kHz and an upper boundary of 6 kHz have been found to be acceptable boundaries. For wideband and/or full-band applications the lower boundary lies between 7 kHz and 8 kHz and the upper boundary lies above 7 kHz, in particular above 10 kHz, in particular above 15 kHz, in particular above 20 kHz.

For determining the quality parameter which is a measure for signal-correlated noise, in a pre-defined frequency range, from a mean magnitude short-time spectrum of the pre-processed output signal a mean magnitude short-time spectrum of the pre-processed input signal and a mean magnitude short-time spectrum of the estimated background noise is subtracted. This difference is normalized to a mean magnitude short-time spectrum of the pre-processed input signal to describe the signal-correlated noise in the pre-processed output-signal. The resulting spectrum is evaluated to determine the dimension parameter "signal-correlated noise", wherein said pre-defined frequency range has a lower boundary between 0 Hz and 8 kHz and an upper boundary between 3.5 kHz and 20 kHz.

A frequency range, which has been found acceptable with respect to signal-correlated noise, for narrowband applications, has a lower boundary of essentially 3 kHz and an upper boundary of 4 kHz.

The speech quality measure related to noisiness is determined by calculating a linear or a non-linear combination of selected ones of the above quality parameters.

In a third embodiment in accordance with the invention a method for determining a speech quality measure of an output speech signal with respect to an input speech signal, wherein said input signal passes through a signal path of a data transmission system resulting in said output signal, comprises the steps of pre-processing said input and/or output signals, transforming the frequency spectrum of the pre-processed output signal, wherein the frequency scale is transformed into a pitch scale (by way of example only, the Bark scale), and the level scale is transformed into a loudness scale, detecting the part of the transformed output signal which comprises speech, and determining said speech quality measure as a mean pitch value of the detected signal part. This method is adapted to determine the perceptual dimension related to the loudness of the output signal relative to the input signal.

If the input and output signals are digital speech files, the speech quality measure is determined depending on the digital level and/or the playing mode of said digital speech files and/or on a pre-defined sound pressure level.

In this third embodiment, both the input and output signals can be pre-processed, for instance for the purpose of level-alignment. However, since also in this third embodiment only the pre-processed output signal might be further processed, it can also be within the scope of the invention to only pre-process the output signal.

In a fourth embodiment in accordance with the invention a method for determining a speech quality measure of an output speech signal with respect to an input speech signal, wherein said input signal passes through a signal path of a data transmission system resulting in said output signal, comprises the steps of pre-processing said input and output signals, determining from the pre-processed input and output signals a frequency response and/or a corresponding gain function of the signal path, determining at least one feature value representing a pre-defined feature of the frequency response and/or the gain function, determining said speech quality measure from said at least one feature value.

This method is adapted to determine the perceptual dimension related to the directness and/or the frequency content of the output signal relative to the input signal, wherein said at least one pre-defined feature comprises a bandwidth of the gain function, and/or a center of gravity of the gain function, and/or a slope of the gain function, and/or a depth of peaks and/or notches of the gain function, and/or a width of peaks and/or notches of the gain function. However, any other feature related to perceptual dimension of "directness/frequency content" of the speech signals to be analyzed are also within the scope of the invention. A bandwidth is determined as an equivalent rectangular bandwidth (ERB) of the frequency response, since this is a measure which provides an approximation to the bandwidths of the filters in human hearing.

Advantageously the gain function is transformed into the Bark scale, which is a psychoacoustical scale proposed by E. Zwicker corresponding to critical frequency bands of hearing.

Furthermore, the pre-defined features can be determined based on a selected interval of the frequency response and/or the gain function. The gain function can be decomposed into a sum of a first and a second function, wherein said first function represents a smoothed gain function and said second function represents an estimated course of the peaks and notches of the gain function.

The determined pre-defined features are combined to provide the speech quality measure which is an estimation of the perceptual dimension "directness/frequency content", wherein for instance a linear combination of the feature values is calculated. However, the speech quality measure is determined by calculating a non-linear combination of the feature values, which is adapted to fit the respective audio band of the speech transmission channel under consideration.

The step of pre-processing in any of the above described methods comprises the steps of selecting a window in the time domain for the input and/or output signals to be processed, and/or filtering the input and/or the output signal, and/or time-aligning the input and output signals, and/or level-aligning the input and output signals, and/or correcting frequency distortions in the input and/or the output signal and/or selecting only the output signal to be processed. Level-aligning the input and output signals preferably comprises normalizing both the input and output signals to a pre-defined signal level, wherein said pre-defined signal level essentially is 79 dB SPL, 73 dB SPL or 65 dB SPL.

Since the above described methods for determining individual perceptual dimensions of the speech signals are utilized in a full-reference model, in a fifth embodiment in accordance with the invention a method for determining a speech quality measure of an output signal with respect to an input signal, wherein said input signal passes through a signal path of a data transmission system resulting in said output signal, comprises the steps of processing said input and output signals for determining a first speech quality measure, determining at least one second speech quality measure by performing a method according to any one of the above described first, second, third or fourth embodiment, and calculating from the first speech quality measure and the at least one second speech quality measures a third speech quality measure. Calculating the third speech quality measure may comprise calculating a linear or a non-linear combination of the first and second speech quality measures.

The first speech quality measure can be determined by means of a method based on a known full-reference model, as for instance by way of example only the PESQ or the TOSQA model.

In an embodiment in accordance with the invention, at least two second speech quality measures are determined by performing different methods. Four second speech quality measures are determined by respectively performing each of the above described methods according to the first, second, third and fourth embodiment.

The first, second and/or third speech quality measures provide an estimate for the subjective quality rating of the signal path expected from an average user, in particular as a value in the MOS scale, in the following also referred to as MOS score.

In an embodiment of the invention, a device for determining a speech quality measure of an output speech signal with respect to an input speech signal, wherein said input signal passes through a signal path of a data transmission system resulting in said output signal is adapted to perform a method according to any one of the above described first, second, third or fourth embodiment.

The device comprises a pre-processing unit with inputs for receiving said input and output speech signals, and a processing unit connected to the output of the pre-processing unit, wherein said processing unit preferably comprises a microprocessor and a memory unit.

In an embodiment of the invention, a system for determining a speech quality measure of an output speech signal with respect to an input speech signal, wherein said input signal passes through a signal path of a data transmission system resulting in said output signal, comprises a first processing unit for determining a first speech quality measure from said input and output speech signals, at least one device as described above for determining a second speech quality measure from said input and output speech signals, and an aggregation unit connected to the outputs of the first processing unit and each of said at least one devices, wherein said aggregation unit has an output for providing said speech quality measure and is adapted to calculate an output value from the outputs of the first processing unit and each of said at least one device depending on a pre-defined algorithm.

The devices for determining a second speech quality measure have respective outputs for providing said second speech quality measure, which is a quality estimate related with a respective individual perceptual dimension.

In another embodiment of the invention, at least two devices for determining a second speech quality measure are provided, and one device is provided for each of the above described perceptual dimensions "directness/frequency content", "continuity", "noisiness" and "loudness".

In another embodiment the system further comprises a mapping unit connected to the output of the aggregation unit for mapping the speech quality measure into a pre-defined scale, in particular into the MOS scale.

A typical setup of a full-reference model known from the prior art is schematically depicted in FIG. 1. An input signal x(k) and an output signal y(k), resulting from transmitting the input signal x(k) through a transmission channel 100, are provided to a pre-processing unit 210. The unit 210 for instance is adapted for time-domain windowing, pre-filtering, time alignment, level alignment and/or frequency distortion correction of the input and output signals resulting in the pre-processed signals x'(k) and y'(k). These pre-processed signals are transformed into an internal representation by means of respective transformation units 221 and 222, resulting for instance in a perceptually-motivated representation of both signals. A comparison of the two internal representations is performed by comparison unit 230 resulting in a one-dimensional index. This index typically is related to the similarity and/or distance of the input and output signal frames, or is provided as an estimated distortion index for the output signal frame compared to the input signal frame. A time-domain integration unit 240 integrates the indices for the individual time frames of one index for an entire speech sample. The resulting estimated quality score, for instance provided as a MOS score, is generated by transformation unit 250.

Figure 2:
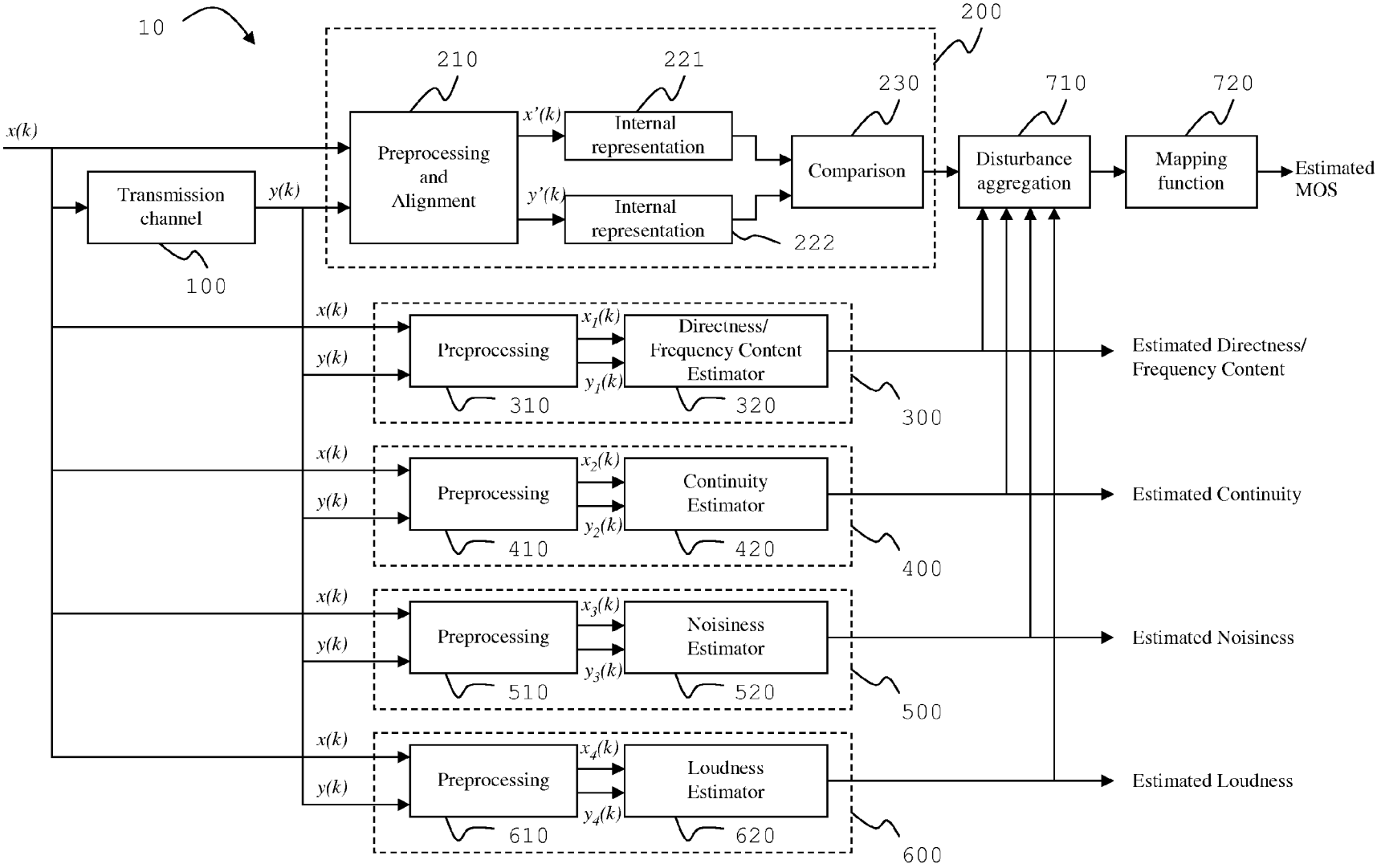
FIG. 2 a schematic view of an embodiment in accordance with the invention.

In FIG. 2 an embodiment of an inventive system 10 for determining a speech quality measure is schematically depicted.

The shown system 10 is adapted for a new signal-based full-reference model for estimating the quality of both narrow-band and wideband-transmitted speech. The characteristics of this approach comprise an estimation of four perceptually-motivated dimension scores with the help of the dedicated estimators 300, 400, 500 and 600, integration of a basic listening quality score obtained with the help of a full-reference model and the dimension scores into an overall quality estimation, and separate output of the overall quality score and the dimension scores for the purpose of planning, designing, optimizing, implementing, analyzing and monitoring speech quality.

The system shown in FIG. 2 comprises an estimator 300 for the perceptual dimension "directness/frequency content", an estimator 400 for the perceptual dimension "continuity", an estimator 500 for the perceptual dimension "noisiness", and an estimator 600 for the perceptual dimension "loudness". In the shown embodiment each of the estimators 300, 400, 500 and 600 comprises a pre-processing unit 310, 410, 510 and 610 respectively and a processing unit 320, 420, 520 and 620 respectively. However, also a common pre-processing unit can be provided for selected or for all estimators.

A disturbance aggregation unit 710 is provided which combines a basic quality estimate obtained by means of a basic estimator 200 based on a known full-reference model with the quality estimates provided by the dimension estimators 300, 400, 500 and 600. The combined quality estimate is then mapped into the MOS scale by means of mapping unit 720.

As an output of the system 10 a diagnostic quality profile is provided, which comprises an estimated overall quality score (MOS) and several perceptual dimension estimates.

As an input to each of the units 200, 300, 400, 500 and 600, the clean reference speech signal x(k), the distorted speech signal y(k), and in case of digital input the sampling frequency are provided. In case of acoustical interfaces being part of the transmission channels, the speech signals are the equivalent electrical signals, which are applied or have been obtained at these interfaces.

The basic estimator 200 can be based on any known full-reference model, as for instance PESQ or TOSQA.

The pre-processing unit 310, 410, 510 and 610 are adapted to perform a time-alignment between the signals x(k) and y(k). The time-alignment may be the same as the one used in the basic estimator 200 or it may be adapted for the respective individual dimension estimator.

The "directness/frequency content" estimator 300 is based on measured parameters of the frequency response of the transmission channel 100. These parameters comprise the equivalent rectangular bandwidth (ERB) and the center of gravity ($\Theta_G$) of the frequency response. Both parameters are measured on the Bark scale. Further suitable parameters comprise the slope of the frequency response as well as the depth and the width of peaks and notches of the frequency response.

The speech quality measure provided by estimator 300 preferably is determined by calculating a linear combination of the above parameters, i.e. by the following equation $$\hat{DF} = C_1 + C_2 \cdot \mathrm{ERB} + C_3 \cdot \Theta_G + C_4 \cdot S + C_5 \cdot D + C_6 \cdot W$$

wherein $C_1$-$C_6$: Constants,

ERB: Equivalent rectangular bandwidth,
$\Theta_G$: Center of gravity,
S: Slope,
D, W: Depth and width of peaks and notches.

The constants $C_1$-$C_6$ preferably are fitted to a set of speech samples suitable for the respective purpose. This can for instance be achieved by utilizing training methods based on artificial neural networks. However, as would be readily understood by a person of ordinary skill, other ways of utilizing training methods are within the contemplation of the invention.

An example of the above equation determined by the inventors based on an exemplary set of speech samples and utilizing only ERB and $\Theta_G$ is given below:

$$\hat{DF} = -20.5865 + 0.2466\frac{ERB}{\text{Bark}} + 1.8730\frac{\Theta_G}{\text{Bark}}$$

However, calculating the speech quality measure related to "directness/frequency content" is not limited to a linear combination of the above parameters, but can comprise calculating non-linear terms.

In one embodiment the speech quality measure provided by estimator 300 therefore is determined by calculating the following equation:

$$\hat{DF} = \sum_{n=0}^{N}\sum_{m=0}^{M}\sum_{j=1}^{5}\sum_{i=1}^{5} C_{i,j,n,m}\cdot V_i^n\cdot V_j^m$$

wherein
$V_1$=ERB; $V_2=\Theta_G$; $V_3$=S; $V_4$=D; $V_5$=W
N, M$\epsilon\{0, 1, 2, 3, \ldots\}$
$C_{i,j,n,m}$: Constants with at least one $C_{i,j,n,m}\neq 0$ with n>0 and m>0

An of the above non-linear equation is given below:

$$\hat{DF} = -2.059\cdot C_A\cdot C_B + 4.485\cdot C_A^2 + 24.334\cdot C_A + 5.677\cdot C_B + 54.096$$

with $$C_A = 3.79 - 0.38\cdot\frac{ERB}{\text{Bark}}$$

$$C_B = 2.12 - 0.23\cdot\frac{\Theta_G}{\text{Bark}}$$

In the shown embodiment, the estimator 400 for estimating the speech-quality dimension "continuity", in the following also referred to as C-Meter, is based on the estimation of two signal parameters: a speech signal's interruption rate as well as musical tones present within a speech signal.

In the following the functionality of an example of an embodiment of estimator 400 is described.

The detection of a signal's interruption rate is based on an algorithm which detects interruptions of a speech signal based on an analysis of the temporal progression of the speech signal's energy gradient.

The algorithm for the detection of interruptions first calculates the short-time spectrum $$X(\mu,i)=\text{DFT}\{x(k,i)\}$$

of the distorted speech signal x(k). In this formula, the parameter μ denotes the frequency index of the DFT values. The parameter i indicates the number of the current frame of length M=40 samples (≙5 ms). During the calculation of the short-time spectrum X(μ,i) each frame x(k,i) is weighted using a Hamming window. Subsequent frames do not overlap during this calculation.

For each frequency index μ the temporal gradient $G_\mu(\mu, i, i+1)$ of the signal energy is calculated:

$$G_\mu(\mu,i,i+1)=|X(\mu,i+1)|^2-|X(\mu,i)|^2.$$

The summation over all temporal gradients $G_\mu(\mu, i, i+1)$ within the frequency region of the telephone-band ($\mu_u$≙300 Hz–$\mu_o$≙3.4 kHz) provides the gradient G(i,i+1)

$$G(i, i+1) = \sum_{\mu=\mu_u}^{\mu_o} G_\mu(\mu, i, i+1).$$

The normalization of the gradient G(i,i+1) to the energy of the $i^{th}$ frame provides the normalized gradient $G^n(i,i+1)$:

$$G^n(i, i+1) = \min\left(\frac{G(i, i+1)}{\sum_{\mu=\mu_u}^{\mu_o}|X(\mu, i)|^2}, 1\right).$$

The result for the energy gradient lies in between −1 and +1. An energy gradient with a value of approximately −1 indicates an extreme decrease of energy as it occurs at the beginning of an interruption. At the end of an interruption an extreme increase of energy is observed that leads to an energy gradient of approximately +1.

The algorithm detects the beginning of an interruption in case an energy gradient of $G^n(i,i+1)<-0.99$ occurs. The end of an interruption is indicated by the first subsequent energy gradient of $G^n(i,i+1)=1$. Using the knowledge about the overall length of a speech signal x(k) and the indicators for the beginning and end of interruptions, an interruption rate Ir can be calculated.

For the use of this algorithm for the estimation of the interruption rate within the instrumental estimator 400 for "continuity", some constants within this algorithm can be adapted with respect to pre-defined test data for providing optimal estimates for the interruption rate for a given purpose.

The detection of musical tones is based on the idea of the "Relative Approach" described in "Objective Evaluation of Acoustic Quality Based on a Relative Approach" by K. Genuit, 1996, in: Proc. Internoise'96, Liverpool, UK.

As described in "Application of the Relative Approach to Optimize Packet Loss Concealment Implementations" by F. Kettler et al., 2003, in: Fortschritte der Akustik—DAGA 2003, Aachen, 18-20 Mar. 2003, Deutsche Gesellschaft für Akustik, DEGA e.V., the idea behind the "Relative Approach" is to compare the actual current signal value with an estimate for the current signal value from the signal history to detect time changes within acoustic signals that are unexpected and unpleasant for the human ear. As it is described in Genuit (1996) and Kettler (2003) the "Relative Approach" includes a hearing model in the analysis method.

In the C-Meter, i.e. in estimator 400, the idea of the "Relative Approach" is applied directly to the short-time spectrum of a speech signal. To detect musical tones, a speech signal's short-time spectrum is analyzed within equidistant frequency bands. Musical tones are detected for those time-frequency-pairs t, f, where the spectral amplitude X(t,f) fulfills two conditions: (1) the actual current spectral amplitude X(t,f) is higher than the expected current spectral amplitude $\hat{X}(t,f)$, which is the mean of the preceding spectral amplitude values:

$$\hat{X}(t, f) = \frac{1}{N}\sum_{i=10}^{1} X(t-i, f);$$

and (2) the difference between the actual current spectral amplitude and the estimate of the current spectral amplitude exceeds a certain threshold.

Thus, no hearing model is used in the C-Meter 300, contrary to the known "Relative Approach". In the C-Meter 300 only the basic idea of the "Relative Approach" of comparing the actual current signal value with an estimate of the current signal is applied.

From the results of the detection of the musical tones within a speech file two parameters are derived describing the characteristics of the musical tones: one parameter that indicates the mean amplitude of the musical tones, $MT_a$, and one parameter that indicates the frequency of the musical tones' occurrence, $MT_f$.

The estimate of a speech signal's continuity is obtained as a linear combination of the dimension parameters "interruption rate" and "musical tone intensity":

$$\hat{C}=0.9274-0.7297\cdot Ir-0.0029\cdot MT_a\cdot MT_f.$$

The above equation represents only an exemplary model on which the estimator 300 may be based. A changed or altered model of course also lies within the scope of the invention. In particular, beside "interruption rate" and "musical tone intensity" more parameters which have an influence on the human perception of the dimension "continuity" can be additionally taken into account. Examples of such additional parameters comprise "front/end clipping rate" and "packet loss rate", since are expected to also affect the human perception of the dimension "continuity".

In a described embodiment the estimator 500 for the perceptual dimension "noisiness", in the following also referred to as N-Meter, is based on the instrumental assessment of four parameters that the inventors have found to be related to the human perception of a signal's noisiness: a signal's background noise $BG_N$, a parameter taking into account the spectral distribution of a signal's background noise $FS_N$, the high-frequency noise $HF_N$, and signal-correlated noise $SC_N$. An estimate for the "noisiness" of a speech file, $\hat{N}$, is obtained by a linear combination of these four parameters:

$$\hat{N}=\beta_0+\beta_1\cdot BG_N+\beta_2\cdot FS_N+\beta_3\cdot HF_N+\beta_4\cdot SC_N.$$

The dimension parameter "background noise", $BG_N$, is based on an analysis of the noise during speech pauses:

$$BG_N = 10\cdot\log_{10}\left[\frac{1}{96}\sum_{\mu=1}^{96} B_\mu\cdot\left(\frac{1}{K}\cdot\sum_{k=1}^{K}\left(\hat{\Phi}_{nn}(\Omega_{\mu,k})-\Phi_{xx}(\Omega_{\mu,k})\right)\Big|_{k=pause}\right)\right].$$

Here, $\hat{\Phi}_{nn}(\Omega_\mu,k)|_{k=pause}$ describes the power-density spectrum of the processed speech file during speech pauses and is thus assumed to describe the background noise contained in a speech file. $\Phi_{xx}(\Omega_\mu,k)|_{k=pause}$ describes the spectrum of the original speech file during speech pauses. The difference of both spectra is assumed to describe the amount of noise added to a speech signal due to the processing. The difference of both spectra is averaged over all time segments k=1 . . . K. The mean difference of both spectra is weighted psophometrically and averaged over all frequency values from 0 to 4 kHz, which corresponds to averaging over the frequency indices μ=1 . . . 96.

The dimension parameter "frequency spreading", $FS_N$, takes into account the spectral shape of background noise. It is assumed that the frequency content of noise influences the human perception of noise. White noise seems to be less annoying than colored noise. Furthermore, loud noise seems to be more annoying than lower noise. These assumptions are verified by the auditory test of the dimension "noisiness" described in "Untersuchungen zur messtechnischen Erfassung und systematischen Beeinflussung der Sprachqualitätsdimension 'Rauschhaftigkeit'" by Ch. Kühnel, 2007, Diploma Thesis, Institute for Circuit and System Theory, Christian-Albrechts-University, Kiel. In the instrumental assessment of "noisiness" these assumptions are modeled by the dimension parameter $FS_N$:

$$FS_N=|f_{TP}-f_{opt}|\cdot A_{TP}.$$

$|f_{TP}-f_{opt}|$ describes the deviation of the center of gravity of the noise spectrum from the ideal center of gravity. In case of "white noise" in the frequency range from 0 Hz to 4 kHz, the corresponding spectrum is flat within the frequency range from 0 Hz to 4 kHz and thus the center of gravity of the noise spectrum lies at $f_{opt}$=2 kHz. In case of colored noise, the center of gravity deviates from this ideal center of gravity. The parameter $A_{TP}$ describes the energy of the noise spectrum. This parameter thus models the effect, that loud noise is more annoying than low noise. This effect is modeled in combination with a deviation of the center of gravity from its ideal point.

This means that it is assumed that a deviation of the center of gravity from its ideal point always occurs.

The dimension parameter "high-frequency noise", $HF_N$, is determined as a noise-to-signal ratio in the frequency range from 4 kHz to 6 Hz:

$$NSR(\Omega_\mu, k) = 10\cdot\log_{10}\frac{B_\mu\cdot\hat{\Phi}_{nn}(\Omega_\mu, k)|_{k=pause}}{A_\mu\cdot\Phi_{xx}(\Omega_\mu, k)|_{k=speech}}$$

Herein, $\hat{\Phi}_{nn}(\Omega_\mu,k)|_{k=pause}$ describes the power-density spectrum of the processed speech file during speech pauses and $\Phi_{xx}(\Omega_\mu,k)|_{k=speech}$ describes the spectrum of the original speech file during speech. While the noise is psophometrically weighted, the speech spectrum is weighted using the A-norm that models the sensitivity of the human ear. The noise-to-signal ratio $NSR(\Omega_\mu,k)$ per frequency index $\Omega_\mu$ and time index k is integrated over all frequency and time indices to provide an estimate for the high-frequency noise $HF_N$. A sophisticated averaging function using different $L_p$-norms is used.

Exemplary, for determining the dimension parameter "signal-correlated noise", $SC_N$, first a difference of a minuend and a subtrahend is determined. The minuend is given by the ratio of the mean magnitude spectrum $|\overline{Y}(\mu)|$ of the pre-processed output signal minus the mean magnitude spectrum $|\overline{X}(\mu)|$ of the pre-processed original signal and the mean magnitude spectrum $|\overline{X}(\mu)|$ of the pre-processed original signal. The mean spectra $|\overline{X}(\mu)|$ and $|\overline{Y}(\mu)|$ are calculated as the average of the magnitude-short-time spectra $|X(\mu,n)|$ and $|Y(\mu,n)|$ during signal segments with speech activity. Here the parameter n indicates the number of the considered signal segment. The subtrahend is given by the ratio of the mean magnitude spectrum $|\overline{N}(\mu)|$ of the estimated background noise and the mean magnitude spectrum $|\overline{X}(\mu)|$ of the pre-processed original signal. The mean magnitude spectrum $|\overline{N}(\mu)|$ is calculated as the average magnitude-short-time spectrum $|Y(\mu,n)|$ during speech pauses. The respective formula for calculating the signal-correlated noise spectrum is given below:

$$NC(\mu) = \frac{|\overline{Y}(\mu)| - |\overline{X}(\mu)|}{|\overline{X}(\mu)|} - \frac{|\overline{N}(\mu)|}{|\overline{X}(\mu)|}.$$

with $|\overline{Y}(\mu)|$: Mean magnitude spectrum of the pre-processed output signal calculated within signal segments with speech activity, $|\overline{X}(\mu)|$: Mean magnitude spectrum of the pre-processed original signal, i.e. the input signal, calculated within signal segments with speech activity, $|\overline{N}(\mu)|$: Mean magnitude spectrum of the estimated background noise, $\mu$: Frequency index, wherein $$N(\mu) = \left( \frac{1}{K} \cdot \sum_{k=1}^{K} \left( \hat{\Phi}_{nn}(\Omega_{\mu,k}) \right) \Big|_{k=pause} \right)$$

The dimension parameter "signal-correlated noise", $SC_N$, is determined as a function of the above spectrum of the signal-correlated noise essentially between 3 kHz and 4 kHz:

$$SC_N = f(NC(\mu))$$

with $\mu$: Frequency indices corresponding to frequencies between 3 kHz and 4 kHz.

The estimator 600 for the speech-quality dimension "loudness", in the following also referred to as L-Meter, is based on the hearing model described in "Procedure for Calculating the Loudness of Temporally Variable Sounds" by E. Zwicker, 1977, J. Acoust. Soc. Ame., vol. 62, No 3, pp. 675-682. The degraded speech signal is transformed into the perceptual-domain. In particular, the frequency scale is transformed to a pitch scale and the level scale is transformed on a loudness scale.

However, the hearing model may also be updated to a more recent one like the model described in "A Model of Loudness Applicable to Time-Varying Sounds" by B. R. Glasberg and B. C. J. Moore, 2002, J. Audio Eng. Soc., vol. 50, pp. 331-341, which is more related to speech signals.

In addition, a Voice Activity Detection (VAD) is used in order to find speech parts in the signal. The loudness meter does not take into account noise-only signal parts.

The speech quality measure provided by the loudness meter 600 corresponds to a mean over the speech part and the pitch scale of the degraded speech signal.

The loudness is estimated as a mean over the Bark scale (24 points) of a 16 ms frame from the output signal according to the following equation:

$$\overline{\text{Loudness}}[n] = \frac{1}{24} \sum_{i=1}^{24} \text{Loudness}[i, n]$$

Consecutively a mean over the speech part is calculated according to the following equation:

$$\overline{\text{Loudness}} = \frac{1}{N} \sum_{i=1}^{N} \overline{\text{Loudness}}[N]$$

These N frames of the speech parts are found with a Voice Activity Detection algorithm.

In order to determine the real perceptual loudness, two input parameters are utilized, the output level used during the auditory test (in dB SPL) corresponding to the digital level (in dB ovl) of the speech file, and the playing mode, i.e. monaurally or binaurally played.

Digital levels which are typically used comprise −26 dB ovl and −30 dB ovl, typical output values comprise 79 dB SPL (monaural), 73 dB SPL (binaural) and 65 dB SPL (Hands-Free Terminal).

In the following the functionality of the aggregation unit 710 is described.

The output provided by the basic estimator 200 is used in order to provide a reference score $R_0$ on the extended R scale of the E model defined in the value range [0:130]. The extended R scale is an extended version of the R scale used in the E-model. The E-model is a parametric speech quality model, i.e. a model which uses parameters instead of speech signals, described in ITU-T recommendation G.107 (2005). The extended R scale is for instance described in "Impairment Factor Framework for Wide-Band Speech Codecs" by S. Möller et al., 2006, IEEE Trans. on Audio, Speech and Language Processing, vol. 14, no. 6.

This result takes into account only the non-linear degradation due to the processing part like speech codec, noise concealment algorithms, and the like.

The output of the L-Meter 600 is transformed into an impairment factor Ie_loud by means of a pre-defined function:

$$Ie_loud = f(\overline{\text{Loudness}})$$

This impairment factor is also defined in the value range [0:130]. Since too high and too low speech levels can be seen as degradations, this function might be non-monotonic.

The outputs of the other meters 300, 400 and 500 are also transformed into impairment factors. Since the degradation is a function of the loudness, the output of the L-meter 600 is also a parameter, resulting in the following equations for the respective impairment factors:

$$Ie_cont = g(\hat{C}, \overline{\text{Loudness}})$$

$$Ie_direct = h(\hat{\text{DF}}, \overline{\text{Loudness}})$$

$$Ie_noisiness = l(\hat{N}, \overline{\text{Loudness}})$$

A $MOS_i$ score is provided for each dimension using a mapping function between the $R_i$ score for this dimension and the $MOS_i$ according to the following equations:

$$R_i = R_0 - Ie_i$$

$$MOS_i = f(R_i)$$

The overall R score, $R_{ov}$, is found from the reference $R_0$ and the different impairment factors $Ie_i$ using the following equation:

$$R_0 = R_0 - Ie_loud - Ie_cont - Ie_direct - Ie_noisiness$$

Accordingly an overall MOS score is determined as a function of the overall R score:

$$MOS_{ov} = f(R_{ov})$$

The invention may be applied to any of the following types of telecommunication systems, corresponding to the transmission channel 100 in FIGS. 1 and 2:

Public switched networks, for instance fix wired PSTN, GSM, WCDMA, CDMA, or the like, Push-over-Cellular, Voice over IP and PSTN-to-VoIP interconnections, Tetra and commonly-used speech processing components, as for instance codecs, noise reduction systems, adaptive gain control, comfort noise, and their combinations, narrow-band, mixed band, wideband and full-band transmission channels, 3G and next generation networks including advanced speech processing technologies, acoustical interfaces, and hands-free applications. However, the invention is not so limited and other telecommunication systems are within the contemplation of the invention.

Application scenarios for the inventive approach can comprise planning of telecommunication networks, including terminal equipment, optimization of network components, comparison of networks and network components, monitoring of networks and components, diagnostics of network malfunctions and other problems, and network load calculation and optimization. However, the invention is not so limited and other application scenarios are within the contemplation of the invention.

Accordingly, also the use of any of the methods for determining a speech quality measure described herein for any telecommunication systems and for any application scenarios lies within the scope of the invention.

The methods, devices and systems proposed be the invention can be utilized for narrowband, wideband, full-band and also for mixed-band applications, i.e. for determining a speech quality measure with respect to a transmission channel adapted for speech transmission within the frequency range of the respective band or bands.

The content of all cited documents is incorporated into this application by reference, insofar as methods and/or devices described therein are utilizable for any embodiment of the invention described herein.

Thus, while there have been shown, described, and pointed out fundamental novel features of the invention as applied to several embodiments, it will be understood that various omissions, substitutions, and changes in the form and details of the devices and processes illustrated, and in their operation, may be made by those skilled in the art without departing from the spirit and scope of the invention. Substitutions of elements from one embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

The invention claimed is:

1. A method for determining a speech quality measure of an output speech signal with respect to an input speech signal, wherein the input signal passes through a signal path of a data transmission system resulting in the output signal, the method comprising the steps of:

pre-processing the output signal;

determining a discrete frequency spectrum of the pre-processed output signal within a pre-defined time interval, wherein the discrete frequency spectrum comprises spectral amplitude values for frequency/time pairs based on a pre-defined sampling rate and a number of pre-defined frequency bands;

detecting interruptions in the pre-processed output signals so as to determine an interruption rate, wherein the detecting includes determining a gradient of the discrete frequency, wherein the start of an interruption is identified by a gradient which lies below a first threshold, and the end of the interruption is identified by a gradient which lies above a second threshold;

detecting musical tones so as to determine a measure for intensity of musical tones, wherein the detecting includes determining an expected amplitude value for each frequency-time pair and determining frequency/time pairs for which the spectral amplitude value is higher than the expected amplitude value and a difference between the spectral amplitude value and the expected amplitude value exceeds a pre-defined threshold; and determining the speech quality measure by calculating a combination of the interruption rate and the measure for intensity of musical tones.

2. The method of claim 1, wherein the pre-defined frequency bands lie within a pre-defined frequency range having a lower boundary between 0 Hz and 500 Hz and an upper boundary between 3 kHz and 20 kHz.

3. The method of claim 2, wherein the lower boundary is 300 Hz and the upper boundary is 3.4 kHz.

4. The method of claim 2, wherein the lower boundary is 50 Hz and the upper boundary lies between 7 kHz and 8 kHz.

5. The method of claim 2, wherein the upper boundary lies above 7 kHz.

6. The method of claim 1, wherein the pre-defined sampling rate lies between 0.1 ms and 200 ms.

7. The method of claim 1, wherein the pre-defined frequency bands are substantially equidistant.

8. The method of claim 1, further comprising pre-processing the input signal.

9. The method of claim 8, wherein pre-processing the output signal and pre-processing the input signal include at least one of the following steps:

selecting a window in a time domain for at least one of the input signal or the output signal to be processed, filtering at least one of the input signal or the output signal, time-aligning the input signal and the output signal, level-aligning the input signal and the output signal, or correcting frequency distortions in the input signal and the output signal, and selecting only the output signal to be processed.

10. The method of claim 9, wherein the level-aligning includes normalizing both the input signal and output signal to a pre-defined signal level.

11. The method of claim 10, wherein the pre-defined signal level is about one of 79 dB SPL, 73 dB SPL, and 65 dB SPL.

12. The method of claim 1, further comprising:

determining an additional speech quality measure by processing the input signal and the output signal; and calculating a further additional speech quality measure from the speech quality measure and the additional speech quality measure.

13. The method of claim 12, wherein the additional speech quality measure is determined using a method based on the PESQ or the TOSQA full-reference model.

14. The method of claim 12, wherein at least one of the speech quality measure, the additional speech quality measure, or the further additional speech quality measure provides an estimate for a subjective quality rating of the signal path expected from an average user.

15. A method for determining a speech quality measure of an output speech signal with respect to an input speech signal, wherein the input signal passes through a signal path of a data transmission system resulting in the output signal, the method comprising the steps of:

pre-processing the input signal and the output signal;

detecting intervals of speech pauses in the pre-processed input signal and the pre-processed output signal;

determining from the pre-processed input signal and the pre-processed output signal at least one quality parameter by comparing discrete frequency spectra of the pre-processed input signal and the pre-processed output signal within the speech pauses, wherein the at least one quality parameter is a measure of at least one of:

a background noise introduced into the output signal relative to the input signal, a center of gravity of a spectrum of the background noise, an amplitude of the background noise, a high-frequency noise introduced into the pre-processed output signal relative to the pre-processed input signal, or a signal-correlated noise introduced into the output signal relative to the input signal; and determining said speech quality measure from the at least one quality parameter.

16. The method of claim 15, wherein the step of comparing the discrete frequency spectra includes the step of calculating a psophometrically weighted difference between the spectra in a pre-defined frequency range having a lower boundary between 0 Hz and 0.5 kHz and an upper boundary between 15 kHz and 8.0 kHz.

17. The method of claim 16, wherein the lower boundary is about 0 Hz and the upper boundary is about 4 kHz.

18. The method of claim 16, wherein the lower boundary is about 0 Hz and the upper boundary lies between 7 kHz and 8 kHz.

19. The method of claim 15, further comprising the step of calculating a difference between the center of gravity of the spectrum of the background noise and a pre-defined value representing an ideal center of gravity, wherein the pre-defined value equals 2 kHz.

20. The method of claim 15, wherein the quality parameter which is a measure of the high-frequency noise is determined as a noise-to-signal ratio in a pre-defined frequency range with a lower boundary between 3.5 kHz and 8.0 kHz and an upper boundary between 5 kHz and 30 kHz.

21. The method of claim 20, wherein the lower boundary is about 4 kHz and the upper boundary is about 6 kHz.

22. The method of claim 20, wherein the lower boundary lies between 7 kHz and 8 kHz and the upper boundary lies above 7 kHz.

23. The method of claim 15, further comprising the steps of:

determining a mean magnitude short-time spectrum of the pre-processed output signal, of the pre-processed input signal and of an estimated background noise;

subtracting from the mean magnitude short-time spectrum of the pre-processed output signal the mean magnitude short-time spectrum of the pre-processed input signal and the mean magnitude short-time spectrum of the estimated background noise;

normalizing the result of the subtraction to a mean magnitude short-time spectrum of the pre-processed input signal; and determining the quality parameter which is a measure of the signal-correlated noise from the normalized result within a pre-defined frequency range having a lower boundary between 0 Hz and 8 kHz and an upper boundary between 3.5 kHz and 20 kHz.

24. The method of claim 23, wherein the lower boundary is about 3 kHz and the upper boundary is about 4 kHz.

25. A system for determining a speech quality measure of an output speech signal with respect to an input speech signal, wherein the input speech signal passes through a signal path of a data transmission system resulting in the output speech signal, the system comprising:

a first processing unit for determining a first speech quality measure from the input speech signal and the output speech signal, the first processing unit having outputs;

a device including a pre-processing unit configured to pre-process the output signal and including inputs for receiving the input signal and the output speech signals, and including a second processing unit connected to an output of the pre-processing unit for determining a second speech quality measure from the input speech signal and the output speech signal, the second processing unit being configured to:

determine a discrete frequency spectrum of the pre-processed output signal within a pre-defined time interval, wherein the discrete frequency spectrum comprises spectral amplitude values for frequency/time pairs based on a pre-defined sampling rate and a number of pre-defined frequency bands;

detect interruptions in the pre-processed output signals so as to determine an interruption rate, wherein the detection includes determining a gradient of the discrete frequency, wherein the start of an interruption is identified by a gradient which lies below a first threshold, and the end of the interruption is identified by a gradient which lies above a second threshold;

detect musical tones so as to determine a measure for intensity of musical tones, wherein the detection includes determining an expected amplitude value for each frequency-time pair and determining frequency/time pairs for which the spectral amplitude value is higher than the expected amplitude value and a difference between the spectral amplitude value and the expected amplitude value exceeds a pre-defined threshold; and determine the speech quality measure by calculating a combination of the interruption rate and the measure for intensity of musical tones; and an aggregation unit connected to the outputs of the first processing unit and to the device, the aggregation unit having an output configured to provide the speech quality measure, the aggregation unit being configured to calculate an output value from the first processing unit outputs and the device depending on a pre-defined algorithm.

26. The system according to claim 25, further comprising a further different device for determining a further second speech quality measure.

27. The system according to claim 25, further comprising a mapping unit connected to the output of the aggregation unit and configured to map the speech quality measure into a pre-defined scale.

28. A method for determining a speech quality measure of an output speech signal with respect to an input speech signal, wherein the input signal passes through a signal path of a data transmission system resulting in the output signal, the method comprising the steps of:

pre-processing the input signal and the output signal;

determining from the pre-processed input signal and the pre-processed output signal at least one of a frequency response and a corresponding gain function of the signal path;

determining at least one feature value representing a pre-defined feature of at least one of the frequency response and the corresponding gain function; and determining the speech quality measure from the at least one feature value.

29. The method of claim 28, wherein the at least one pre-defined feature value comprises at least one of a bandwidth of the corresponding gain function, a center of gravity of the corresponding gain function, a slope of the corresponding gain function, a depth of peaks and/or notches of the corresponding gain function, and a width of at least one of peaks and notches of the corresponding gain function.

30. The method of claim 29, further comprising the step of transforming the corresponding gain function into a Bark scale.

31. The method of claim 28, further comprising the step of determining an equivalent rectangular bandwidth (ERB) of the frequency response.

32. The method of claim 28, further comprising the step of selecting an interval of at least one of the frequency response and/or the corresponding gain function, wherein the at least one pre-defined feature is determined based on the interval.

33. The method of claim 28, further comprising the step of decomposing the corresponding gain function into a sum of a first function and a second function, wherein the first function represents a smoothed gain function and the second function represents an estimated course of the peaks and notches of the gain function.

34. The method of claim 28, wherein the speech quality measure is determined by calculating a linear combination of the feature values.

35. The method of claim 28, wherein the speech quality measure is determined by calculating a non-linear combination of the feature values.

36. A device for determining a speech quality measure of an output speech signal with respect to an input speech signal, wherein the input signal passes through a signal path of a data transmission system resulting in the output signal, the device comprising:

a pre-processing unit configured to pre-process the output signal and including inputs for receiving the input signal and the output speech signals, and a processing unit connected to an output of the pre-processing unit and configured to:

determine a discrete frequency spectrum of the pre-processed output signal within a pre-defined time interval, wherein the discrete frequency spectrum comprises spectral amplitude values for frequency/time pairs based on a pre-defined sampling rate and a number of pre-defined frequency bands;

detect interruptions in the pre-processed output signals so as to determine an interruption rate, wherein the detection includes determining a gradient of the discrete frequency, wherein the start of an interruption is identified by a gradient which lies below a first threshold, and the end of the interruption is identified by a gradient which lies above a second threshold;

detect musical tones so as to determine a measure for intensity of musical tones, wherein the detection includes determining an expected amplitude value for each frequency-time pair and determining frequency/time pairs for which the spectral amplitude value is higher than the expected amplitude value and a difference between the spectral amplitude value and the expected amplitude value exceeds a pre-defined threshold; and determine the speech quality measure by calculating a combination of the interruption rate and the measure for intensity of musical tones.

37. The device of claim 36, wherein the processing unit includes a microprocessor and a memory unit.

* * * * *